US005686676A

United States Patent [19]

Jech et al.

[11] Patent Number: 5,686,676

[45] Date of Patent: Nov. 11, 1997

[54] PROCESS FOR MAKING IMPROVED COPPER/TUNGSTEN COMPOSITES

[75] Inventors: David E. Jech; Juan L. Sepulveda; Anthony B. Traversone, all of Tucson, Ariz.

[73] Assignee: Brush Wellman Inc., Cleveland, Ohio

[21] Appl. No.: 646,449

[22] Filed: May 7, 1996

[51] Int. Cl.[6] ..... C22C 27/04; B22F 3/12

[52] U.S. Cl. ..... 75/247; 75/232; 75/248; 419/38; 419/57; 419/58

[58] Field of Search ..... 75/232, 247, 248; 419/22, 38, 57, 58

[56] References Cited

U.S. PATENT DOCUMENTS

| | | | |
|---|---|---|---|
| H363 | 11/1987 | Duvdevani et al. | 44/62 |
| 1,552,184 | 9/1925 | Adams . | |
| 1,848,437 | 3/1932 | Sieger . | |
| 1,860,793 | 5/1932 | Weiger . | |
| 2,294,756 | 9/1942 | Inutsuka et al. . | |
| 2,763,822 | 9/1956 | Frola . | |
| 2,971,251 | 2/1961 | Willemse . | |
| 3,097,329 | 7/1963 | Siemens . | |
| 3,204,158 | 8/1965 | Schreiner et al. . | |
| 3,382,066 | 5/1968 | Kenney et al. . | |
| 3,423,203 | 1/1969 | Zdanuk et al. . | |
| 3,438,753 | 4/1969 | Kenney et al. . | |
| 3,440,043 | 4/1969 | Zdanuk . | |
| 3,685,134 | 8/1972 | Blue | 29/420.5 |
| 3,969,754 | 7/1976 | Kuniya et al. | 357/65 |
| 4,153,755 | 5/1979 | Rothkegel et al. | 428/569 |
| 4,158,719 | 6/1979 | Frantz | 428/562 |
| 4,168,719 | 9/1979 | Renshaw | 137/312 |
| 4,196,442 | 4/1980 | Kuniya et al. | 357/67 |
| 4,430,124 | 2/1984 | Kato | 75/248 |
| 4,451,540 | 5/1984 | Baird et al. | 428/615 |
| 4,500,904 | 2/1985 | Onuki et al. | 357/67 |
| 4,672,417 | 6/1987 | Sugiyama et al. | 357/67 |
| 4,680,618 | 7/1987 | Kuroda et al. | 375/74 |
| 4,736,883 | 4/1988 | Morgan et al. | 228/194 |
| 4,752,334 | 6/1988 | Nadkarni et al. | 75/235 |
| 4,788,627 | 11/1988 | Ehlert et al. | 361/386 |
| 4,988,386 | 1/1991 | Oenning et al. | 75/247 |
| 5,009,310 | 4/1991 | Osada et al. | 357/67 |
| 5,039,335 | 8/1991 | Gondusky et al. | 75/246 |
| 5,049,184 | 9/1991 | Harner et al. | 75/246 |
| 5,086,333 | 2/1992 | Osada et al. | 357/67 |
| 5,099,310 | 3/1992 | Osada et al. | 357/81 |
| 5,379,172 | 1/1995 | Liao | 360/126 |
| 5,379,191 | 1/1995 | Carey et al. | 361/777 |
| 5,380,956 | 1/1995 | Loo et al. | 174/252 |
| 5,386,143 | 1/1995 | Fitch | 257/715 |
| 5,386,339 | 1/1995 | Polinski, Sr. | 361/719 |
| 5,387,815 | 2/1995 | Nishigucki | 257/704 |
| 5,409,864 | 4/1995 | Osada et al. | 437/209 |
| 5,413,751 | 5/1995 | Polese et al. | 419/23 |
| 5,439,638 | 8/1995 | Houck et al. | 419/30 |

FOREIGN PATENT DOCUMENTS

| | | |
|---|---|---|
| 0 100 232 B2 | 7/1983 | European Pat. Off. . |
| 1 143 588 | 9/1960 | Germany . |
| 28 53 951 | 12/1978 | Germany . |
| 48-111978 | 10/1973 | Japan . |
| 54-105584 | 8/1979 | Japan . |
| 56-37538 | 3/1981 | Japan . |
| 857569 | 12/1960 | United Kingdom . |
| 931820 | 7/1963 | United Kingdom . |
| WO 94/27765 | 12/1994 | WIPO . |

OTHER PUBLICATIONS

Making Ceramic Composites by Melt Infiltration. William B. Hillig. Rensselaer Polytechnic Institute—vol. 73, No. 4, Apr. 1994.

Mi-Tech Metals, Inc.—Bulletin 201-1.

Mo-Cu Composites for Electronic Packaging Applications. Kirk, Caldwell and Oakes. Research & Development Group, LaVergne, TN.-Not Date.

A Theory of Activated Liquid Phase Sintering and Its Application to the W-Cu System. J.L. Johnson and R.M. German-Dept. of Engineering Science and Mechanics, Pennsylvania State University. No Date.

What is CMSH—Sumitomo Electric Industries, Ltd. No Date.

Advanced New Materials from Sumitomo Electric Heat Sink Materials. No Date.

LEC's Manufacturing Process—High Thermal Conductivity, Low CTE, Lightweight and High Stiffness-Lanxide Electronic Components, L.P., Newark, DE. No Date.

The Solubility Criterion for Liquid Phase Sintering. J.L. Johnson and Randall German-Advances in Powder Metallurgy & Particular Materials-1994, vol. 3.

Powder Metallurgy Processing of Thermal Management Material for Microelectronic Applications: R.M. German, K.F. Hens, and J.L. Johnson. P/M Lab, Dept. of Engineering Science and Mechanics-The Pennsylvania State University. No Date.

Phase Equilibria Effects on the Enhanced Liquid Phase Sintering of Tungsten-Cooper. J.L. Johnson and R.M. German-Metallurgical Transactions A, vol. 24A, Nov. 1993.

Factors Affecting the Thermal Conductivity of W-Cu Composites. J.L. Johnson and R. M. German. P/M Lab-Pennsylvania State University. No Date.

A Model for the Thermal Properties of Liquid-Phase Sintered Composites-Randall M. German-Metallurgical Transactions A, vol. 24A, Aug. 1993.

W-cu and Mo-Cu for Microelectronic Packaging Applications: Processing Fundamentals. John L. Johnson, Karl F. Hens, and Randall M. German. P/M Lab, Dept of Engineering Science and Mechanics. The Pennsylvania State University. No Date.

(List continued on next page.)

*Primary Examiner*—Ngoclan Mai

*Attorney, Agent, or Firm*—Calfee, Halter and Griswold LLP

[57] ABSTRACT

The sinterability of a copper/tungsten green compact is improved by using copper oxide, tungsten oxide or both as the copper and/or tungsten source. Sinterability is further enhanced by including steam in the sintering atmosphere.

26 Claims, 2 Drawing Sheets

OTHER PUBLICATIONS

The Manufacturing Near Net Shape of Cu–W Composite Materials–Yasunao Kai, Chiaki Yamasaki, Kentaro Yukuhiro and Tadashi Okabe: Nippon Tungsten Co., Ltd. Japan. No. Date.

The Effect of W Powder Size on the Microstructure and Mechanical Property of W–25wt%Cu Alloy: J–S, Lee, T–H Kim T–G Kang, S–Lee, M–H Hong and J–W Noh: Dept. of Metallurgy and Materials Science, Hanyang University, Ansan, Korea. No Date.

Study on Powder Injection Molding Ball Milled W–Cu Powders. Bing Yang & Randall M. German: P/M Lab, The Pennsylvania State University. NO Date.

Pilot Production of Advanced Electronic Packages via Powder Injection Molding. Karl F. Hens, John L. Johnson and Randall M. German: Advances in Powder Metallurgy & Particular Materials–1994, vol. 4.

Powder Systems and Applications: Metals Handbook Ninth Edition, vol. 7. No Date.

SEM Evaluation of Two Selected Hosokawa Test Runs: Teledyne Advanced Materials Nashville R&D Facility: Feb. 7, 1995.

Powder Metallurgy Processing of Thermal Management Materials for Microelectronic Applications: Randall M. German, Karl F. Hens, and John L. Johnson: International Journal of Powder Metallurgy, vol. 30, No. 2, 1994.

The Journal of the Institute of Metals, vol. LXII, 1938: Sintered Alloys. Part 1. Copper–Nickel–Tungsten Alloys Sintered With a Liquid Phase Present.

The Identification of Enhanced Sintering Systems Through Phase Diagrams. R.M. German: Materials Engineering Department, Rensselear Polytechnic Institute, Troy, NY: MDPM, V15, 1985.

Liquid Phase and Activated Sintering. G. Petzow, W.A. Kaysser and M. Amtenbrink: Theory and Practice. Proceedings of the 5th International Round Table Conference on Sintering, Portoroz, Yugoslavia–7–10 Sep., 1981.

Enhanced Sintering of Tungsten–Phase Equilibria Effects on Properties: C.J. Li and R.M. German: International Journal of Powder Metallurgy & Powder Technology, vol. 20, No. 2, 1984 American Powder Metallurgy Institute.

The Properties of Tungsten Processed Chemically Activated Sintering. Chaojin LI and R.M. German. Metallurgical Transactions, vol. 14A, Oct., 1983.

Enhanced Low–Temperature Sintering of Tungsten. R.M. German and Z.A. Munir: Metallurgical Transactions; vol. 7A, Dec., 1976.

The Effect of Nickel and Palladium Additions on the Activated Sintering of Tungsten. R.M. German and V. Ham. International Journal of Powder Metallurgy & Powder Technology, vol. 12. No 2, Apr. 1976.

Systematic Trends in the Chemically Activated Sintering of Tungsten. R.M. German and Z.A. Munir. High Temperature Science 8, 267–280 (1976).

The Activated Sintering of Tungsten with Group VIII Elements. H.W. Hayden and J.H. Brophy. Journal of the Electrochemical Society, Jul., 1963.

Prediction of Segregation to Alloy Surfaces from Bulk Phase Diagrams–J.J. Burton and E.S. Machlin: Physical Review Letters, vol. 37, No. 21, 22 Nov. 1976.

An Update on the Theory of Liquid Phase Sintering: R.M. German and S. Farooq: Materials Engineering Dept. Rensselaer Polytechnic Institute. No Date.

Theory of Liquid Phase Sintering: Model Experiments on W–Ni–Fe Heavy Alloy System: S. Farooq, A. Bose and R.M. German: Materials Engineering Department, Rensselaer Polytechnic Institute. No Date.

Present state of liquid phase sintering. W.A. Kaysser and G. Petzow. Powder Metallurgy 1985, vol. 28, No. 3.

Rhenium activated sintering: R.M. German and Z.A. Munir. Journal of the Less–Common Metals, 53 (1977).

Temperature sensitivity in the chemically activated sintering of hafnium. R.M. German, Z.A. Munir. Journal of the Less–Common Metals, 46 (1976).

Heterodiffusion Model for the Activated Sintering of Molybdenum. R.M. German and Z.A. Munir: Journal of the Less–Common Metals, 58 (1978).

A Quantitative Theory of Diffusional Activated Sintering. R.M. German. Science of Sintering, vol. 15, No. 1, Jan., 1983.

G.V. Samsonov and V.I. Yakovlev. Electronic Mechanism of Activated Sintering of Tungsten. No Date.

Modelling of Rearrangement Processes in Liquid Phase Sintering. W.J. Huppmann and H. Riegger. ACTA Metallurgical, vol. 23, 1975.

Activated Sintering of Tungsten with Palladium Additions. G.V. Samsonov and V.I. Yakovlev: Institute of Materials Science. Academy of Sciences of the UkrSSR. Translated from Poroshkovaya Metallurgiya, No. 7(55) pp.45–49, Jul., 1967. Original article Aug. 30, 1966.

Activated Sintering of Tungsten With Nickel Additions. G.V. Samsonov and V.I. Yakovlev. Institute of Material Science, Academy of Sciences of the UkrSSR. Translated from Poroshkovaya Metallurgiya, No. 8(56), pp.10–16, Aug., 1967. Original article submitted Apr. 12, 1966.

Theory and Technology of Sintering, Thermal, and Chemicothermal Treatment Processes—Activation of the Sintering of Tungsten By The Iron–Group Metals: G.V. Samsonov and V.I. Yakovlev. Institute of Material Science, Academy of Sciences of the Ukrainian SSR. Translated from Poroshkovaya Metallurgiya, No. 10(82), pp. 32–38, Oct., 1969. Original article submitted May 21, 1968.

Activation of the Sintering Process of Tungsten By the Platinum–Group Metals. G.V. Samsonov and V.I. Yakovlev: Institute of Materials Science, Academy of Sciences of the Ukrainian SSR. Translated from Poroshkovaya Metallurgiya, No. 1(85), p. 37–44, Jan., 1970. Original article submitted Jul. 29, 1968.

A Generalized Model for the Prediction of Periodic Trends in the Activation of Sintering of Refractory Metals–Z.A. Munir and R.M. German. High Temperature Science 9, 275–283 (1977).

A Modified Model For the Sintering Of Tungsten With Nickel Additions–Gessinger and Fischmeister. Journal of the Less–Common Metals, 27 (1972).

Shape accommodation during grain growth in the presence of a liquid phase. Kaysser, Zivkovic and Petzow. Journal of Materials Science 20 (1985) 578–584.

Gravity and Configurational Energy Induced Microstructural Changes in Liquid Phase Sintering. Kipphut, Bose, Farooq and German. Metallurgical Transactions A, vol. 19A, Aug. 1988.

The Two–Dimensional Connectivity of Liquid Phase Sintered Microstructures–R.M. German. Metallurgical Transactions A, vol. 18A, May, 1987.

The Effect of Contiguity on Growth Kinetics in Liquid–Phase Sintering. Sung–Chul Yang, S.S. Mani and R.M. German.JOM, Apr. 1990.

The Sintering and Strength of Coated and Co–Reduced Nickel Tungsten Powder. Brophy, Hayden and Wulff. Transactions of The Metallurgical Society of AIME, vol. 221, Dec. 1961.

Spray Drying—An Introduction to Principles, Operational Practice and Application. K. Masters. 1976.

Theories der Alterung von Niederschlagen durch Umlosen (Ostwald–Reifung) Von Carl Wagner. No. Date.

Microstructure of the Gravitationally Settle Region in a Liquid–Phase Sintered Dilute Tungsten Heavy Alloy. Randall M. German. Metallurgical and Materials Transactions A, vol. 26A, Feb. 1996.

The Influence of a Partially Wetting Second Phase On The Sintering Of Solid Particles. Gessinger, Fischmeister and Lukas. Powder Metallurgy, vol. 16, No. 31. No Date.

A Comparative Assessment of Explosive and Other Methods of Compaction in the Production of Tungsten–Copper Composites. A.K. Bhalla and J.D. Williams. Powder Metallurgy 1976, No. 1.

Sintering of W–Cu Contact Materials with Ni and Co Dopants. Moon and Lee. Powder Metallurgy International, vol. 9, No. 1, 1977.

Characterization of the Degree of Mixing in Liquid–Phase Sintering Experiments. Huppmann and Bauer. Powder Metallurgy, 1975, vol. 18. No. 36.

Cermets: II, Wettability and Microstructure Studies in Liquid–Phase Sintering. Parikh and Humenik, Jr. Journal of The American Ceramic Society, vol. 40, No. 9.

Densification and Grain Growth During Liquid–Phase Sintering of Tungsten Nickel–Copper Alloys. Kothari. Journal Less–Common Metals, 13 (1967) 457–468.

Fine–Grained W–Cu–Co Alloys via Liquid Phase Sintering. Wittenauer and Nieh. Lockheed Missiles & Space Co. Tungsten and Tungsten Alloys–Recent Advances Edited by Andrew Crowson and Edward s. Chen The Minerals, Metals & Materials Society, 1991.

Nickel in Tungsten–Copper Contacts. Teodorovich and Levchenko. Institute or Materials Problems, Academy of Sciences, Ukr. SSR Translated from Poroshkovaya Metallurgiya, No. 6 (24), pp. 43–47. Nov.–Dec., 1964. Original article submitted Jan. 28, 1964.

Liquid Phase Sintering Under Pressure of Tungsten–Nickel–Copper Composites. Naidich, Lavrinenko, and Evdokimov. Institute of Materials Science, Academy of Sciences of the Ukrainian SSR. Translated from Poroshkov Metallurgiya, No. 4(172), pp. 43–49, Apr., 1977. original article submitted Jul. 14, 1976.

Influence of W–Particle Size on Electrical Contact Property of Ni–Doped W–Cu Contact Materials. Jai–Sung Lee, In–Sup Ahn, In–Hyung Moon (Department of Materials Engineering, Hanyang University, Seoul, Korea) No Date.

Powder–Metallurgy Solutions To Electrical Contact Problems. Stevens. Powder Metallurgy, 1974, vol. 17. No. 34.

Burn–off Behaviour of W–Cu Contact Materials in an Electric Arc.. Gessinger and Melton. Powder Metallurgy International, vol. 9, No. 2, 1977.

Sintering Behaviour on Tungsten–Silver Contact Materials with Cobalt Additions. Moon and Huppmann. No Date.

Instrumentation of a Production Powder Metallurgy Press for measurement of Compaction and Ejection Stresses. Mallender, Dangerfield and Coleman. No Date.

Thermal Properties of Materials Used For Heat Sink Applications. Neumann. No Date.

Thermal Diffusivity of Cemented Carbides. Neumann. Austrian Research Centre Seibersdorf Department of Materials Technology Lenaugasse, Vienna. No Date.

Effect of Tungsten Particle Size on Sintered Properties of Heavy Alloys. Srikanth and Upadhyaya. Indian Institute of Technology, Kanpur (India). Received Aug. 19, 1983; revised form Oct. 26, 1983.

Spheroid Growth by Coalescence During Liquid–Phase Sintering. Zukas, Pamela S.Z. Rogers and R. Scott Rogers. Z Metallkde, 1976.

Reaction of Carbon With Molybdenum During Indirect Sintering. E.M. Grinberg, I.V. Tikhonova, B.I. Ol'shanskii, A.B. Ol'shanskii, and M. Yu. Zapol. Tulachermet Scientific–Production Association. Tula Polytechnic Institute. Translated from Poroshkovaya Metallurgiya, No. 8(284), pp.20–25, Aug., 1986. Original article submitted Nov. 19, 1985.

Kinetics of Densification and Growth of Refractory Phase Grains In the Liquid–Phase Sintering of Very Finely Divided Tungsten–Copper Materials. Prokushev and Smirnov. Institute of Materials Science, Academy of Sciences of the Ukrainian SSR. Translated from Poroshkovaya Metallurgiya, No. 9(285), pp. 30–37, Sep., 1986. Original article submitted Jan. 28, 1986.

Kinetics of the Change of Density Distribution In Hot One–Sided Pressing Of A Viscous Porous Body. Buchatskii, Stolin, and Khudyaev. Department of the Institute of Chemical Physics, Academy of Sciences of the USSR, Chernogolovka. Translated from Poroshkovaya Metallurgiya, No. 9(285), pp. 37–42, Sep., 1986. Original article submitted Jan. 28, 1986.

Theory and Technology of Sintering, Thermal, and Chemicothermal Treatment Processes. Structural Inhomogeneity and Localization of Densification in the Liquid–Phase Sintering of Tungsten–Copper Powder Mixtures. Skorokhod, Panichkina, Prokushev. Institute of Materials Science, Academy of Sciences of the Ukrainian SSR. Translated from Poroshkovaya Metallurgiya, No. 8 (284), pp. 14–19, Aug., 1986. Original article submitted Nov. 13, 1985.

Theory and Technology of Sintering, Thermal, and Chemicothermal Treatment Processes: Sintering of Tungsten–Copper Composites of Various Origins. Skorokhod, Solonin, Filippov, and Roshchin. Institute of Materials Science, Academy of Sciences of the Ukrainian SSR. Translated from Poroshkovaya Metallurgiya, No. 9(249), pp. 9–13, Sep., 1983. Original article submitted Jun. 30, 1982.

Theory and Technology of Sintering, Thermal, and Chemicothermal Treatment Processes: Liquid–Phase Sintering of Very Fine Tungsten–Copper Powder Mixtures. Panichkina, Sirotyuk, and Skorokhod. Institute of Materials Science, Academy of Sciences of the Ukrainian SSR. Translated from Poroshkovaya Metallurgiya, No. 6(234), pp. 27–31, Jun., 1982. Original article submitted Jul. 31, 1981.

Difussion Mechanisms In the Liquid Phase Sintering of Tungsten Alloys. Dr. Andrew Crowson, Metallic Materials Branch, Materials & Manufacturing Technology Division. Fire Control & Small Caliber Weapon Systems Laboratory U.S. Army Research & Development Center, Dover, NJ. No Date.

Some Observations on the Mechanism of Liquid Phase Sintering. Cannon and Lenei. Rensselaer Polytechnic Institute. No Date.

The Development of High Strength, Heat Treatable Products from Alloy Powders. Comstock and Clark. Stevens Institute of Technology, Hoboken. No Date.

Tungsten and Tungsten Alloys By Powder Metallurgy—A Status Review. Belhadjhamida, German. Materials Engineering Dept of Rensselaer Polytechnic Institute. No Date.
Properties and Uses of the Pseudobinary Alloys of Cu with Refractory Metals. No Date.
High Density Tungsten–Copper Liquid Phase Sintered Composites from Coreduced Oxide Powders. Sebastian and Tendolkar. The International Journal of Powder Metallurgy & Powder Technology. vol. 15 No. 1. 1979.
Activated sintering of tungsten–copper contact materials. Moon and Lee. Powder Metallurgy 1979, No. 1.
Factors Affecting Tungsten–Copper and Tungsten–Silver Electrical Contact Materials. Kothari. Powder Metallurgy, International vol. 14 No. 1, 1982.
Chemically Activated Liquid Phase Sintering of Tungsten–Copper. John L. Johnson and Randall M. German. The International Journal of Powder Metallurgy, vol. 30, No. 1, 1994.
Sintering In The Presence Of Liquid Phase. Huppmann. The Forth International Conference on Sintering and Related Phenomena. University of Notre Dame, Notre, Dame, Indiana, U.S.A., May 26–27, 1975.
Microstructural Changes in W–Cu and W–Cu–Ni Compacts During Heating Up For Liquid Phase Sintering. Lee, Kaysser and Petzow. No Date.
Enhanced sintering through second phase additions. R.M. German and B. H. Rabin. Powder Metallurgy, 1985, V28, pp. 7–12.
New Low–Expansion Alloys for Semiconductor Applications. Solid State Technology. Jan., 1969.
A Comparison of Thin flim, Thick film, and Co–Fired High Density Ceramic Multilayer With The Combined Technology: T&T HDCM (Thin flim and Thick film High Density Ceramic Module). Dr. M. Terasawa and S. Minami and J. Rubin. Kyocera Coporation. The International Journal For Hybrid Microelectronics. vol. 6, No. 1, Oct., 1983.
Fundamental Principles of Powder Metallurgy. W.D. Jones. Scientific Library U.S. Patent Office. Sep. 14, 1961.

PROCESS FOR MAKING IMPROVED COPPER/TUNGSTEN COMPOSITES

The present invention relates to improved copper/tungsten and copper/molybdenum composites and to a new process for making such composites.

Copper/tungsten and copper/molybdenum composites are widely used in various electrical applications due to their relatively high thermal conductivities of 150 to 240 W/mK. Moreover, because the coefficient of thermal expansion of the composites can be controlled by varying their Cu/W and Cu/Mo ratios, these composites find significant use in electronic packaging applications where tailoring the composite to match the thermal expansion characteristics of the chip or other device attached thereto is highly desired.

Copper/tungsten and copper/molybdenum composites can be made by a number of techniques. In one technique, known as infiltration, a shaped article formed from a sintered mass of tungsten or molybdenum particles is contacted with molten copper. As a result, copper is infused into the voids and interstices between the sintered tungsten or molybdenum particles, thereby forming a completed composite.

In another technique, a powdery mixture of copper oxide particles and tungsten oxide particles is reduced in a dry (i.e. dewpoint=<–40° C.) hydrogen atmosphere, the reduced powder mixed with a binder and the mixture so-obtained compacted and sintered. Additional copper can be added by infiltration, if desired. See U.S. Pat. No. 3,382,066 to Kenney et al., the disclosure of which is incorporated herein by reference.

A similar technique is illustrated in U.S. Pat. No. 5,439,638 to Houck et al., the disclosure of which is also incorporated herein by reference. In this technique, a mixture of tungsten powder, copper oxide powder and optionally cobalt powder is milled in an aqueous medium to form a slurry, the liquid removed from the slurry to form spherical, flowable agglomerates, the agglomerates subjected to a reducing atmosphere to form a flowable tungsten/copper composite powder, and the powder so formed then compacted and sintered to form the copper/tungsten composite.

A common disadvantage associated with known processes for forming copper/tungsten and copper/molybdenum composites is that they are relatively complicated in nature. For example, infiltration processes are generally unable to produce net shape parts. This requires the parts produced by infiltration to be machined into final shape, thereby greatly increasing complexity of manufacture and cost. Also, typical infiltration processes require the extra steps of binder burn-off and pre-sintering. Moreover, in such processes the pre-sintered compact is often relatively friable, which may result in part breakage and associated downtime. Also, during the infiltration process, which is typically carried out in a separate furnace, excess copper may form pools or bleedout, resulting in the production of defective parts which must be discarded or at least subjected to extra machining after firing. Copper infiltration may also require special fixturing and complicated furnace equipment.

Processes involving co-reduction of oxide powders also involve extra processing steps and are hence inherently complex. Also, machining after firing is still necessary in many instances.

Because of these complexities and disadvantages, commercial manufacture of copper/tungsten and copper/molybdenum composites is still relatively expensive. Also, production of copper/tungsten and copper/molybdenum composites with densities approaching theoretical, i.e. 97% or more of theoretical, has been difficult.

Accordingly, there is a need for a new process for producing copper/tungsten and copper/molybdenum composites which is easier and less expensive to carry out than prior art processes and which is capable of producing composites with densities of 97% and more of theoretical rapidly and consistently.

SUMMARY OF THE INVENTION

In accordance with the present invention, it has been discovered that copper/tungsten and copper/molybdenum composites having densities of 97% or more of theoretical can be easily produced by sintering a copper/tungsten or copper/molybdenum compact in a reducing atmosphere if the copper in the compact is either in oxide form or, if in metallic form, is present with another material in the compact which will decompose to yield oxygen for reacting with the copper in the compact under sintering conditions.

In accordance with a preferred embodiment of the invention, it has been further found that sintering can be facilitated by including steam in the reducing atmosphere.

In accordance with another preferred embodiment of the invention, it has also been found that sintering can be further facilitated if the powders of copper and tungsten or molybdenum used as raw materials in the inventive process are combined together to form free-flowing agglomerates prior to forming the sintering compact.

In a still further preferred embodiment of the invention, it has also been found that spontaneous combustion of the source powders used to form the sintering compacts of the present invention can be reduced or eliminated by including a corrosion inhibitor in the powders.

Accordingly, the present invention provides an improved process for producing a copper/tungsten or copper/molybdenum composite in which a compacted mass of copper-containing particles and particles containing tungsten or molybdenum is sintered in a reducing atmosphere, the compact further containing oxygen chemically-bound to the copper in the compact or to another material in the compact which will decompose to yield oxygen for reacting with the copper in the compact under sintering conditions.

In addition, the present invention also provides an improved process for producing a copper/tungsten or copper/molybdenum composite in which a compacted mass of copper-containing particles and particles of tungsten or molybdenum is sintered in a reducing atmosphere, the reducing atmosphere containing sufficient steam to improve the sintering operation.

In addition, the present invention further provides a process for producing a composite containing copper and a transition metal in which a compact of copper-containing particles and transition metal-containing particles is sintered in a reducing atmosphere, the compact being composed of a compacted mass of flowable agglomerates formed from transition metal-containing particles and copper-containing particles, the agglomerates further containing chemically-bound oxygen and preferably being made without reducing any copper oxide, tungsten oxide or molybdenum oxide in the agglomerates, if any, to a metallic state.

In addition, the present invention still further provides a process for retarding spontaneous combustion of a powdery material, particularly the powdery materials used for forming the compacts of the present invention, the process comprising treating the powdery material with a corrosion inhibitor.

BRIEF DESCRIPTION OF THE DRAWINGS

The present invention may be more readily understood by reference to the following drawings wherein.

DETAILED DESCRIPTION

In accordance with the present invention, a compacted mass of copper-containing particles and particles containing a transition metal such as tungsten or molybdenum is sintered in a reducing atmosphere, the compacted mass containing oxygen chemically-bound to the copper or tungsten in the compact or chemically-bound with another material in the compact capable of releasing oxygen under sintering conditions.

Figure 1:
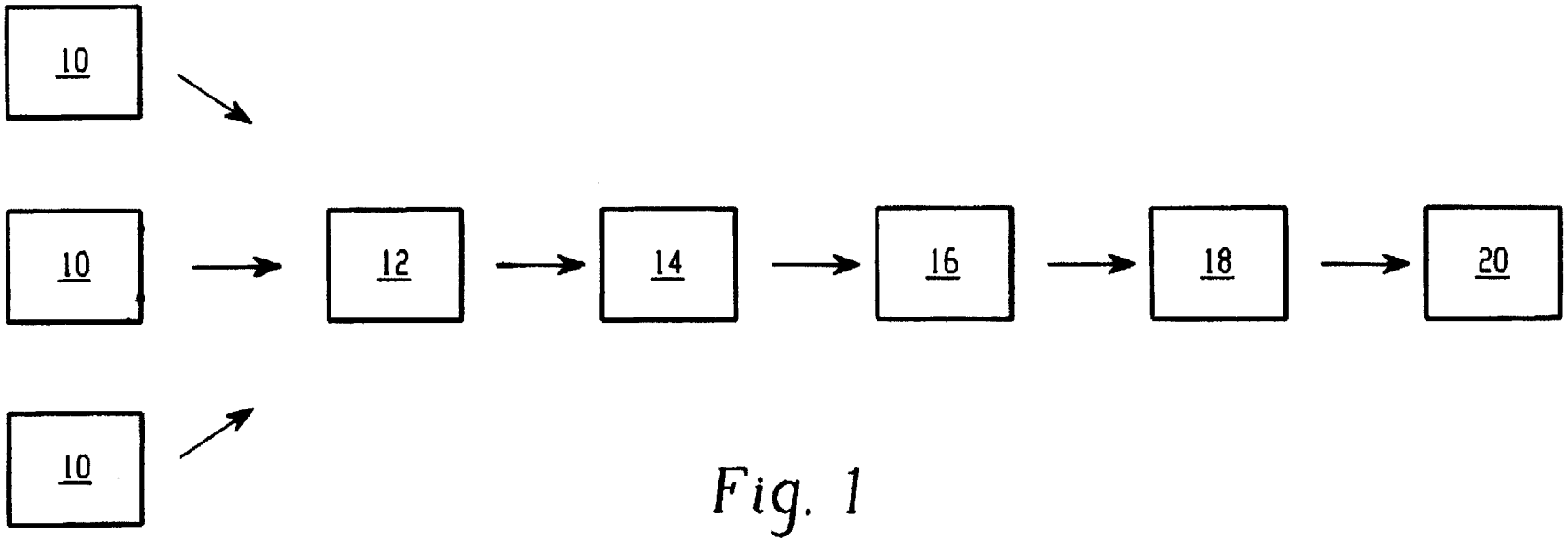
FIG. 1 in schematic flow diagram of one embodiment of the invention process.

A flow scheme for one example of the inventive process is illustrated in FIG. 1. In this flow scheme, the raw material powders used in the inventive process are charged from individual supply containers in a raw material station 10 into admixing station 12 where they are intimately admixed together. From admixing station 12, the admixed raw materials are then charged into an agglomerator 14 where they are formed into agglomerates as further discussed below. These agglomerates are then transferred to compaction station 16 where they are charged into a suitable mold and compacted to form a green compact. The green compact so formed is then charged into a sintering station 18, such as an oven, where it is sintered to form a completed compact in accordance with the present invention, generally shown at 20.

Details of the inventive process are discussed below:

Raw Materials

The primary raw materials used in the inventive process are particles containing the metals forming the desired composite product. Raw material powders useful for forming copper/tungsten and copper molybdenum composites by powder metallurgy are well known in the art and any such materials can be used in the inventive process. Typically, metallic copper powder, metallic tungsten powder and metallic molybdenum powder are used for this purpose, the powders having mean particle sizes on the order of 0.3 to 10 microns. To the extent that other elements, such as other transition metals, can be used to form composites with copper by powder metallurgy techniques, they can also be used for forming composites in accordance with the present invention as well.

A second important ingredient .in the raw material package used in the inventive process is chemically-bound oxygen. In accordance with the present invention, it has been found that sintering of copper/tungsten and copper/molybdenum compacts proceeds in an improved manner if chemically-bound oxygen is present in the compact. Although not wishing to be bound to any theory, it is believed that inclusion of chemically-bound oxygen in the compact causes a copper oxide/copper metal eutectic to form during the sintering operation. This eutectic, it is further believed, has a lower melting point and lower viscosity than molten copper and thereby facilitates sintering through lowering of the temperature necessary for sintering, increasing final product density or both. In any event, by including oxygen in the compact in a manner such that a copper oxide/copper eutectic will form during sintering, the sintering process can be greatly improved.

The easiest way to supply oxygen to the compact for forming a copper/oxide eutectic during sintering is to have the oxygen chemically combined with the copper source powder used as a raw material in the inventive process. However, it is also possible to have the oxygen supplied in another manner. For example, other materials which will decompose under sintering conditions (e.g. 800° C. to 1400° C.) to supply oxygen for forming copper oxide, and which also are free of objectionable impurities, can be included in the system.

Examples of such materials are tungsten oxide ($WO_3$ or $WO_4$) as well as molybdenum oxide ($MoO_3$ or $MoO_2$). Oxides of any other element to be included in the system can also be used, provided that they decompose during sintering to yield oxygen capable of reacting with copper.

Interestingly, most organic compounds containing oxygen cannot be used for supplying oxygen, since they decompose at 300° C. or less. Accordingly, any oxygen available from such compounds is effectively lost to the system well before normal sintering temperatures are reached. In the same way, externally supplied oxygen, i.e. molecular oxygen, is not an effective substitute for chemically-bound oxygen, since it cannot be uniformly distributed throughout the compact mass. Moreover, molecular oxygen would react with the molybdenum or other metal liners or supports used in the sintering furnace, and is therefore clearly undesirable. In any event, materials other than the copper, tungsten and molybdenum raw material powders used in the inventive process can be used to provide the chemically-bound oxygen of the present invention, so long as additional deleterious ingredients are not introduced into the system, and further provided that they decompose to yield oxygen for forming copper oxide during the sintering operation.

The particle size of the copper-containing powders and transition metal-containing powders used as raw materials in the inventive process is not critical. As well appreciated by those skilled in the art of powder metallurgy, the particle size and particle size distribution of powders used to form sintered articles does have a bearing on the properties of the ultimate products obtained. In accordance with these well known principles, the particle size and particle size distribution of the copper, tungsten and molybdenum-containing raw material powders used in the inventive process should be selected so as to impart maximum density and other desired properties to the composites produced. Preferably, the different raw material powders each have a mean particle size of about 0.3 to 10, preferably 0.8 to 1.1 microns, as this promotes high density in the final sintered product obtained.

Copper, copper oxide, tungsten, tungsten oxide, molybdenum and molybdenum oxide particles are available commercially in these particle size ranges. They are also commercially available in larger particle size ranges, in which case such source powders can be mechanically worked such as by ball milling to reduce the particle size thereof to the desired range.

In a preferred embodiment of the invention, the raw materials used in the inventive process comprise powdery cuprous oxide and tungsten metal. These raw material powders can be directly obtained commercially in the desired particle size ranges, if desired. Alternatively, and preferably, cuprous oxide powder of larger mean particle size and metallic tungsten powder are vigorously admixed in a ball mill or other mechanical mixer prior to use. Cuprous oxide is brittle in nature and therefore is ground to a finer, appropriate size as a result of such mechanical working. At the same time, mechanical working breaks up any agglomerates of tungsten metal particles which may have formed and, additionally, insures homogenous distribution of the individual cuprous oxide particles and tungsten metal particles.

The relative amounts of copper-containing raw material powder and transition metal-containing raw material powder used in the inventive process depends on the desired copper/transition metal ratio in the final composite product. The ratio of copper to tungsten or molybdenum in copper/tungsten and copper/molybdenum composites varies widely, and any such ratio can be used in making the copper/tungsten and copper/molybdenum composites of the present invention. Typically, the inventive composites will have a Cu/W or Cu/Mo weight ratio of about 50/50 to 5/95, more preferably about 10/90 to 45/55, with Cu/W or Cu/Mo weight ratios of about 10/90 to 30/70 being especially preferred for electronic packaging applications.

The amount of chemically-bound oxygen included in the compact to be sintered in accordance with the present invention is not critical. In practical terms, however, there should be enough chemically-bound oxygen present to provide a noticeable improvement in the sintering process. Typically, this translates to an amount of chemically-bound oxygen of at least 50%, preferably 75%, more preferably 100%, of the copper in the compact on a molar basis.

As mentioned above, it is believed that chemically-bound oxygen in the compact results in the formation of a cuprous oxide/metallic copper eutectic under sintering conditions. In addition, it is further believed this eutectic, because it is less viscous than molten copper, facilitates material transport through improved wetting of the tungsten powder and improved capillary flow. In any event, it has been discovered in accordance with the present invention that sintering of copper/tungsten and copper/molybdenum compacts proceeds in an improved manner if chemically-bound oxygen is present as compared with identical processes carried out with chemically-bound oxygen being absent. This improvement can be reflected in a number of different ways, and is typically reflected in a lowering of the sintering temperature necessary to achieve a particular result or the production of a denser sintered product at a given set of sintering conditions.

Accordingly, although the particular amount of chemically-bound oxygen present in the system is not critical, there should be a sufficient amount so as to provide a noticeable improvement in the sintering operation.

In addition to the foregoing components, other ingredients can be included in the raw material package to be compacted and sintered in accordance with the present invention. As well known to those skilled in the art, organic binders are typically included in compacts to be sintered for the purpose of holding the compact together prior to the sintering operation. An organic binder is preferably included in the compacts used in the inventive process for the same purpose.

Essentially any organic material which will function as a binder and which will decompose under sintering conditions without leaving an unwanted residue can be used in the inventive process. Preferred materials are various organic polymer resins such as polyester resins, polyvinyl resins, acrylic resins and the like. Most conveniently, such materials are supplied in the form of aqueous emulsions or dispersions, with acrylic emulsions being particularly preferred. In this connection, it has been found that acrylic emulsions, particularly Rhoplex® B-60A available from Rohm Haas Company of Philadelphia, Pa., is particularly effective in the inventive process in that it provides the necessary green strength to the compact while at the same time decomposing easily leaving very little residual carbon.

Additional conventional ingredients can also be included in the raw material package to be compacted and sintered in accordance with the present invention. If the raw materials are to be admixed in the presence of a liquid, particularly water, conventional cationic, anionic or non-ionic surfactants such as alkoxylated alkyl phenols (e.g. Tergitol® D-683, available from Union Carbide Corporation of Danbury, Conn.) can be included. Viscosity control agents, other organic binders, and other materials can also be included, if desired.

Another ingredient that can be included in the raw material package to be compacted and sintered is a sintering aid. It is well known that certain elements such as cobalt, iron and nickel facilitate sintering during the manufacturing of copper/tungsten composites. Such materials are advantageously incorporated into the sintering compact used in the inventive process for this purpose. Such materials can be added in any form and in any manner known in the art. For example, particles of the sintering aid, either in metallic or in oxide form, can be added in appropriate amounts along with the other raw materials in the raw material mix. In accordance with another embodiment of the invention, as more fully discussed below, the sintering aid can be supplied as contamination from the balls, rods or other pulverizing media used in mixing the raw materials together by milling.

Still another ingredient that can be included in the raw material package to be compacted and sintered in accordance with the present invention is a corrosion inhibitor, i.e. a chemical which functions to retard corrosion of metal through oxidation with oxygen. It is well known in powder metallurgy that fine, particulate, metallic raw material powders such as pure titanium, pure aluminum and pure tungsten often exhibit spontaneous combustion. This occurs because of the high surface area and natural tendency to oxidize of these particles. Spontaneous combustion is a particular problem in manufacturing copper/transition metal composites, particularly Cu/Wo composites, because environmental moisture can set up a galvanic couple between the copper and the transition metal in the raw material powders mix. This galvanic couple, in turn, can generate sufficient heat to initiate the spontaneous combustion phenomenon. Once spontaneous combustion begins, which typically occurs in dead areas of processing equipment or in open batches of product powder, the heat generated is sufficient to sustain the exothermic reaction through the entire powder mass.

In accordance with another aspect of the present invention, it has been found that spontaneous combustion of pyrophoric powders, especially fine metallic powders, can be retarded or eliminated by including in the powders a metal corrosion inhibitor. Examples of suitable metal corrosion inhibitors are benzotriazole, tolyltriazole and combinations thereof. The preferred corrosion inhibitor is benzotriazole.

Thus, in accordance with another preferred embodiment of the invention, a corrosion inhibitor is included in one or more of the raw material powders used for forming the inventive composite for reducing or eliminating spontaneous combustion. In a particularly preferred embodiment of the present invention, such corrosion inhibitors are introduced into the raw material package by treating the copper-containing raw material powder with the corrosion inhibitor prior to admixture thereof with the other ingredients in the system. For example, copper powder or cuprous oxide powder can be soaked in a solution of the corrosion inhibitor in a suitable solvent such as isopropyl alcohol for a suitable period of time, e.g. for 12 hours, prior to admixture with the other ingredients in the system.

Admixture of Raw Materials

The various raw materials used in the inventive process, as described above, are intimately admixed to form a homogenous mass suitable for compaction. This can be accomplished in any conventional manner. For example, the raw materials can be mixed by means of mechanical mixers such as high shear mixers, blenders and the like. They can also be mixed in various types of mills such as ball mills, rod mills and so forth.

In a preferred embodiment, the raw materials are mixed in the presence of a liquid, preferably water. This may be accomplished in mechanical mixers, such as high sheer mixers or blenders (e.g. a Patterson-Kelly Blender or a V-blender), in which case the amount of liquid present should be relatively low, e.g. 0 to 10, preferably 1 to 4 wt. %. This may also be accomplished in various types of milling equipment, in which case the liquid content is usually considerably higher, for example, 40 to 90, preferably 60 to 70 wt. %.

Agglomerates

Once an intimate admixture of raw materials as described above is produced, it can be formed into a compact in any conventional manner. Preferably, however, the raw material admixture is formed into a mass of free-flowing agglomerates first and the agglomerates so formed then used to form the compact.

Forming agglomerates from raw material powders to be compacted and sintered into copper/tungsten composites is known. However, in such processes, the raw material powders are typically subjected to a reducing atmosphere for reducing any oxides therein to their elemental state prior to formation of the green compact. The present invention differs from these earlier procedures in that the raw material powders, already containing chemically-bound oxygen, are not reduced to the metallic state prior to or after agglomeration. This maintains a significant amount of chemically-bound oxygen in the agglomerates when compacted and sintered, thereby making this oxygen available for forming a copper oxide/copper metal eutectic during sintering in accordance with the present invention.

Forming free flowing agglomerates from the above raw materials can be accomplished in a variety of different ways. Most easily, this is accomplished by spray drying a liquid mixture of the raw materials. Alternatively, the raw material admixture, typically containing at least some liquid, can be subjected to high sheer mixing until essentially all of the liquid evaporates therefrom, thereby forming agglomerates as the product. In either case, the agglomerates so formed can be screened to remove lumps and foreign matter therefrom, if necessary.

As indicated above, the copper and tungsten-containing powders used as raw materials in the inventive process should have a mean particle size on the order of 0.3 to 10, preferably 0.8 to 1.1, microns, as this promotes high densities in the products obtained by sintering. Unfortunately, powders of this mean particle size, particularly those having a comparatively high portion of fines (i.e. particle size=<325 mesh), do not flow easily. By forming agglomerates of the raw materials, the flowability of the material to be compacted is marketedly improved. This enables the raw material to fill the compaction die much more easily than possible with unagglomerated raw materials. This, in turn, facilitates producing parts of complex shape with a high degree of reproducability on a commercial basis, since defects attributable to poor material flow into the compaction die are largely eliminated.

Preferably, agglomerates as described above are produced such that a mass of the agglomerates exhibits an angle of repose of 35° or less and a Hall flow rate of about 40 seconds or less per 50 grams according to ASTM Procedure B-213 90. More preferably, the agglomerate mass should exhibit an angle of repose of 30° or less and a Hall flow rate of about 30 seconds or less per 50 grams. In accordance with the present invention, it has been determined that agglomerates made in this manner exhibit the most desirable flow properties in terms of filling compaction dies of complex shape. As appreciated by those skilled in the art, producing agglomerates having these flow properties can be easily accomplished through adjusting the conditions of the agglomeration process as well as screening if necessary.

In a particularly preferred technique for forming agglomerates in accordance with the present invention, a mixture of tungsten metal powder and cuprous oxide powder is first ground in a conventional tumbling ball mill in water until the median particle size ($d_{50}$) of the powder mass is reduced to 0.8 to 1.1 micron. After milling, the slurry is then discharged from the mill into mixing tanks. An acrylic emulsion is then added as an organic binder and the slurry so formed is then spray dried to form spherical agglomerates.

In order to introduce cobalt to the raw material mix when this technique is used, cobalt powder in the desired concentration can be introduced into the mill in addition to the other ingredients. In this case, the pulverizing media used in the mill is preferably formed from copper and tungsten in order to prevent contamination of the raw materials with unwanted ingredients. Alternatively, cobalt can be introduced into the system by using balls or other pulverizing media formed from tungsten carbide. Cobalt is the main sintering aid in the manufacture of tungsten carbide, and consequently cobalt from tungsten carbide pulverizing media will contaminate the raw materials being processed by ball milling. This phenomenon can be used in lieu of separate addition of cobalt to supply cobalt as a sintering aid to the system.

In another preferred embodiment for forming agglomerates, ultra fine cuprous oxide (mean particle size of about 0.8 micron), submicron tungsten (mean particle size of 1.1 micron) and ultra fine cobalt (mean particle size of about 1 micron) are thoroughly mixed in water, optionally including a dispersing agent and organic binder, and the dispersion so formed spray dried. In a particular example of this procedure, ultra fine cobalt powder is mixed in water containing a dispersing agent for 10 minutes, then cuprous oxide previously treated with benzotriazole is added and the mixture so obtained mixed for an additional 30 minutes. Ultra fine tungsten powder is then added and the mixture so obtained mixed for an additional 120 minutes. Finally, Rhoplex B-60A acrylic emulsion is added and mixed with the remaining ingredients for an additional 30 minutes, after which the mixture so obtained is sprayed dried.

In either case, agglomerates composed of copper-containing particles, tungsten-containing particles, chemically-bound oxygen and an organic binder are produced which, when dry, are in the form of a free flowing powder having an angle of repose of 35° or less and a Hall flow rate of about 40 seconds or less per 50 grams.

Compaction

The above raw materials, preferably in the form of a free flowing mass of agglomerate powder, are then compacted. This can be accomplished in accordance with any conventional technique. For example, the agglomerate powder can be pressed with either a hydraulic or mechanical press, typically at 15,000 to 30,000 psi, to form a green compact. The dimensions of the green compact are determined by the size of the die used, which in turn is determined by the dimensions of the desired finished composite, taking into account shrinkage of the compact during the sintering operation. Because the foregoing agglomerates exhibit superior flowability, as many as 30 composites or more can be produced from a single press per minute.

Sintering

After the green compacts are removed from the press, they are sintered in a reducing atmosphere. By reducing atmosphere is meant an atmosphere which is capable of reducing copper oxide to copper metal under sintering conditions. Essentially any material can be used for the sintering atmosphere which will accomplish the above reduction. Hydrogen is preferred since it is relatively inexpensive and readily available.

Sintering is preferably accomplished using either a batch furnace or a continuous pusher type furnace. In either case, the furnace is preferably powered by molybdenum elements. Also, it is desirable that alumina, beryllia or other oxide or other material which does not decompose or react under sintering conditions be used as a liner to support the compact in the furnace. Excessive wicking of copper out of the composite can occur if suitable liners are not employed. Also, molybdenum and tungsten liners are not usable as they react with the copper from the composite.

Sintering is accomplished for a time and at a temperature sufficient to cause the green compact to be transformed into a sintered product, i.e. a product having a density of at least 97% of theoretical, preferably at least 99% of theoretical. Sintering conditions suitable for forming copper/tungsten and copper/molybdenum composites are well known and any suitable sintering conditions can be employed in accordance with the present invention. Typically, sintering is conducted at temperatures from 800° to 1400° C., preferably 1000° to 1300° C., more preferably 1050 to 1250° C. for time periods ranging from 0.5 to 5, preferably 1 to 3, more preferably 0.5 to 1, hours.

As appreciated by those skilled in the art, care must be taken during sintering to avoid sintering conditions which are either too benign or too severe. Sintering conditions which are too benign, i.e. insufficient in time or temperature, result in insufficient sintering and the production of product composites which have poor properties in terms of density, strength, fragility and the like. Sintering conditions which are too severe may cause copper to be exuded from the composite body, thereby forming pools of copper on the composite surface.

An example of a sintering regimen which has been found to be particularly effective for manufacture of one copper/tungsten composite in accordance with the present invention involves heating the green compact from room temperature to about 1,050° C. over one hour, maintaining the temperature of the compact at 1,050° C. to 1,250° C. for about 50 minutes, and then decreasing the temperature of the composite so formed back down to room temperature over an additional 50 minutes.

In a preferred embodiment of the invention, steam is included in the sintering atmosphere. Steam in the sintering atmosphere has two effects. First, it converts any tungsten carbide that may be present as contamination from milling into tungsten metal. This is believed to occur by a two step reaction in which tungsten carbide is first converted into tungsten oxide, followed by the tungsten oxide so formed being converted into tungsten metal. The second effect of water vapor is to promote sinterability of the composite. This effect is believed due to a prolongation of the life of the copper oxide in the copper oxide/copper metal eutectic. In any event, improved sinterability attributable to steam in the sintering atmosphere, as in the case of chemically-bound oxygen, is reflected in a number of different ways, the most common being an increase in density of the sintered composite obtained or a lowering of the sintering temperature necessary to achieve a particular result or both.

The amount of steam to be included in the sintering atmosphere is not critical and any amount can be used for this purpose. In practical terms, sufficient steam should be included so that a noticeable improvement in the sintering operation is achieved, either in terms of the quality of the product obtained or a reduction in sintering temperature. Good results have been obtained when the sintering atmosphere contains sufficient water vapor so that it is saturated with water at +20° C., i.e. so that the sintering atmosphere has a dew point of +20° C. Lower amounts of steam, e.g. dew points of 0° C. or even −10° C., are effective.

Final Product

After sintering is complete, the composite so formed can be removed from the sintering furnace and used as is. Alternatively, it can be subjected to tumbling to smooth off sharp edges, eliminate fins generated during dry pressing and to burnish the composite surfaces.

The composites produced in accordance with the present invention can be used in a variety of different electrical applications in the same way as prior art copper/tungsten and copper/molybdenum composites. Preferably, they are used for electronic packaging applications.

For this utility, it is desirable to provide the composites, on one or more surfaces thereof, with a secondary metallic coating for facilitating subsequent attachment of chips and other devices. This can be easily done, for example by plating with nickel using conventional plating processes such as electroless nickel plating, electro plating or the like. Electroless nickel plating is preferred because it produces a dense, uniform coating. Activation of the composite surface can be done with palladium activators or with a nickel strike. The use of a nickel strike is a lower cost process and is thus preferred. Electroless nickel is available with various contents of either boron or phosphorous. Mid-phosphorous (e.g. 7% P) is typically used for copper/tungsten composites because it has the best balance of cost and performance. If desired, the copper/tungsten composites, after being plated with nickel, can be sintered at elevated temperature to bond the nickel to the surface of the composite and to reduce any nickel oxide that may have formed after plating. This can be done, for example, by heating the nickel-plated composite at 825° C. for 5 minutes in a wet (+20° C. dewpoint) 25% hydrogen/75% nitrogen atmosphere. Plated nickel is a very active surface and therefore susceptible to oxidation and staining. Nickel sintering passivates the nickel, thereby reducing its propensity for oxidation.

Metal-coated copper/tungsten composites find wide applications in electronic packaging. If desired, such composites can be further plated with other metals such as gold, copper or silver. Historically, copper/tungsten substrates are brazed to a metallized ceramic. The usual method is to furnace braze with a copper/silver eutectic braze alloy. Other braze alloys or soft solders can also be used. Recently, electronic packages have been developed which require the chip to be attached directly to the copper/tungsten substrate. This requires a substrate to be plated with gold or other suitable metal because such plating is preferred for joining purposes. All of these techniques can be used in connection with the composites of the present invention to provide electronic packages suitable for a wide variety of different applications.

In accordance with the present invention, sintered copper/tungsten and copper/molybdenum composites of high density are produced very easily and without a number of the cumbersome, time consuming and expensive steps required in prior art processes. Also, the inventive process can produce composites with complex shapes rapidly, repeatedly and reliably. Variability in weight and physical dimension between successful parts is very small, which means that post sintering machining and other mechanical working can be totally eliminated.

These advantageous results are due to the improved sintering effect realized through the inclusion of chemically-bound oxygen in the raw material compact. In addition, these advantageous results are also due, at least in part, to the use of agglomerates to form the sintering compact, as these agglomerates facilitate rapid filling of the compaction die very easily. These results are also due, in part, to inclusion of water in the sintering atmosphere as well as to the inclusion of chemically-combined oxygen in the compaction mass, as both of these procedures improve sinterability of the copper/tungsten compact.

As previously indicated, the improved sintering effect realized through incorporating chemically-bound oxygen in the compaction mass is believed due to the formation of a cuprous oxide/copper metal eutectic during the sintering operation. Although this eutectic is formed at 1060° C., which is only a few degrees lower than the melting temperature of copper, the liquid phase generated is believed to be less viscous and to facilitate material transport and particle realignment during sintering in a superior fashion compared with copper. This eutectic is also believed to wet the tungsten or molybdenum powder better than copper metal during sintering. In any event, by including chemically-bound oxygen in the compacted mass subject to sintering, a simpler manufacturing procedure can be employed and moreover products resulting in a higher fired density can be obtained, as compared to sintering processes in which the copper, tungsten and molybdenum are present in metallic form.

WORKING EXAMPLES

The following working examples are provided to more thoroughly illustrate the present invention:

Example 1

1,196 pounds of tungsten metal powder, 247.11 pounds cuprous oxide and 346.41 pounds of deionized water were charged into a ball mill containing tungsten carbide pulverizing media containing cobalt as a sintering aid. The tungsten powder, cuprous oxide powder and water were milled until the mean particle size thereof, $d_{50}$, was less than 1.2 microns, about 24 hours. 36.16 pounds of Rhoplex B-60A acrylic emulsion was then added to the mill and the mixture milled for an additional 30 minutes. The mixture so obtained was then discharged from the mill and spray dried in a niro spray drier at 25,000 psi to form a spray dried agglomerate powder which, after screening, exhibited a Hall flow rate of about 50 seconds per 50 grams.

The agglomerate powder so obtained was used to form 15% copper composites. Each composite was formed by charging the appropriate amount of agglomerate powder into a die having a disk shape and compressing the powder in a press at a pressure of 25,000 psi to form a green compact. The green compact so obtained was then sintered at 1,140° C. for 45 minutes in an astro type furnace in a hydrogen atmosphere containing sufficient water to be saturated at 20° C.

After the composites were withdrawn from the furnace and cooled, they were visually inspected and their densities measured. As a result, it was determined that there was no copper bleedout. In addition, it was further determined that the average density of the composites so made was 15.94 g/cc, which is about 98% of theoretical.

Example 2

3.3 pounds of benzotriazole corrosion inhibitor (Cobratec 99 available from PMC Chemicals) were dissolved in 18.5 pounds of isopropyl alcohol. 84.0 pounds of particulate cuprous oxide were added to the benzotriazole solution and the mixture so obtained allowed to set for 12 hours.

105.1 pounds deionized water and 2.7 pounds cobalt metal having a mean particle size of 1 micron were charged into a mixing tank and mixed for ten minutes. Next, 423.6 pounds of tungsten metal having a mean particle size of 1 micron were slowly added to the other ingredients in the mixing tank and mixed for an additional 120 minutes. Then the previously made-up mixture of cuprous oxide, benzotriazole and isopropyl alcohol was added and the mixture so obtained mixed for an additional 30 minutes. 12.5 pounds of Rhoplex B-60A acrylic emulsion was then added and the mixture obtained mixed for an additional 30 minutes. Thereafter, the mixture so obtained was recovered and spray dried in a niro spray drier to form a flowable mass of particulate agglomerates which, after screening, exhibited a Hall flow rate of about 50 seconds per 50 grams.

Green compacts were made by compressing portions of the above flowable powdery mass at 25,000 psi. The individual green compacts were then fired in an astro furnace at 1,210° C. for 45 minutes in a hydrogen atmosphere containing sufficient water to exhibit a +20° C. dewpoint.

The composite so obtained were inspected visually and their densities determined. As a result, it was determined that copper bleedout was negligible and that the average density was 15.98 grams per cc, about 98% theoretical.

Example 3

The procedure of example 2 was repeated except that the following raw material package was used.

| COMPONENT | AMOUNT (lbs.) |
|---|---|
| tungsten powder | 423.6 |
| cuprous oxide | 84.0 |
| deionized water | 105.1 |
| cobalt | 2.7 |
| benzotriazole | 3.3 |
| alkylated alkyphenol (nonionic surfactant) | 2.5 |
| isopropyl alcohol | 18.5 |
| acrylic emulsion | 12.5 |

Upon analyzing the composites obtained, it was determined that copper bleedout was negligible and moreover the average density of the product obtained was 15.98 grams per cc, about 98% of theoretical.

Example 4

A series of runs was conducted to show the effect of using chemically combined oxygen in the ingredient mix as well as the effect of water in the sintering atmosphere. In each run, composites were produced in accordance with the general procedure of Example 2. In runs A to D, metallic copper was used as the copper source while in runs E and F cuprous oxide was used as the copper source in accordance with the present invention. Also, in runs E and F, the sintering atmosphere was saturated in water at +25° C. and +20° C., respectively.

The results obtained are set forth in the following Table 2.

| Run | Copper Source | Amount of Copper | Mean Particle Size | Temp (°C.) | Dew-point (°C.) | Density (gg/cc) | % Theor. |
|---|---|---|---|---|---|---|---|
| A | Copper | 10% | 1.0 | 1475 | −70 | 16.15 | 94.44 |
| B | Copper | 10% | 1.0 | 1450 | −70 | 15.20 | 88.89 |
| C | Copper | 25% | 1.0 | 1450 | −70 | 13.91 | 94.63 |
| D | Copper | 40% | 1.0 | 1300 | −70 | 13.48 | 98.00 |
| E | Cupr. Oxide | 10% | 1.0 | 1400 | +25 | 17.10 | 100.00 |
| F | Cupr. Oxide | 15% | 1.0 | 1300 | +20 | 16.20 | 100.00 |

As can be seen from Table 2, runs using cuprous oxide as the copper source produced composites having densities of 100% theoretical, while those runs using copper metal as the copper source produced composites with densities less than 100% of theoretical. Furthermore, in run E in which the reducing atmosphere was saturated with water, the sintering temperature could be lowered 75° C. relative to run A in which the reducing atmosphere was dry.

This illustrates the remarkable enhancement that can be realized in terms of the sintering procedure carried out as well as the final product produced by including both. chemically combined oxygen in the compaction mass and by further including water in the sintering atmosphere, as accomplished in accordance with the present invention.

Example 5

A series of runs was conducted using the general procedure of Example 1, except that some or all of the tungsten carbide pulverizing media in the mill was replaced with copper/tungsten media. This resulted in the production of a series of composite products having various amounts of tungsten carbide contamination. Two separate series of runs were conducted. In one series, the reducing atmosphere used in sintering was dry (<−40° C. dewpoint) hydrogen. In the other series, the reducing atmosphere was wet (+20° C. dewpoint) hydrogen.

The composites obtained from each run were recovered and their densities determined. The results obtained are set forth in FIG. 1.

From FIG. 1, it can be seen that in both series of runs, product density decreased as tungsten carbide concentration increased. This shows the significant negative effect of tungsten carbide contamination on copper tungsten composites.

By comparing the two series of runs, however, it can be seen that those runs in which water was included in the sintering atmosphere provided products with significantly higher densities than products made without water being present. This shows the significant positive effect water has on the sintering operation and the products obtained thereby when included in the sintering atmosphere.

Example 6

A series of runs was conducted using the general procedure of Example 2 except that the cobalt concentrations in the different runs were varied. The composite obtained from each run was recovered and their densities determined. The results obtained are set forth in FIG. 2.

Figure 2:
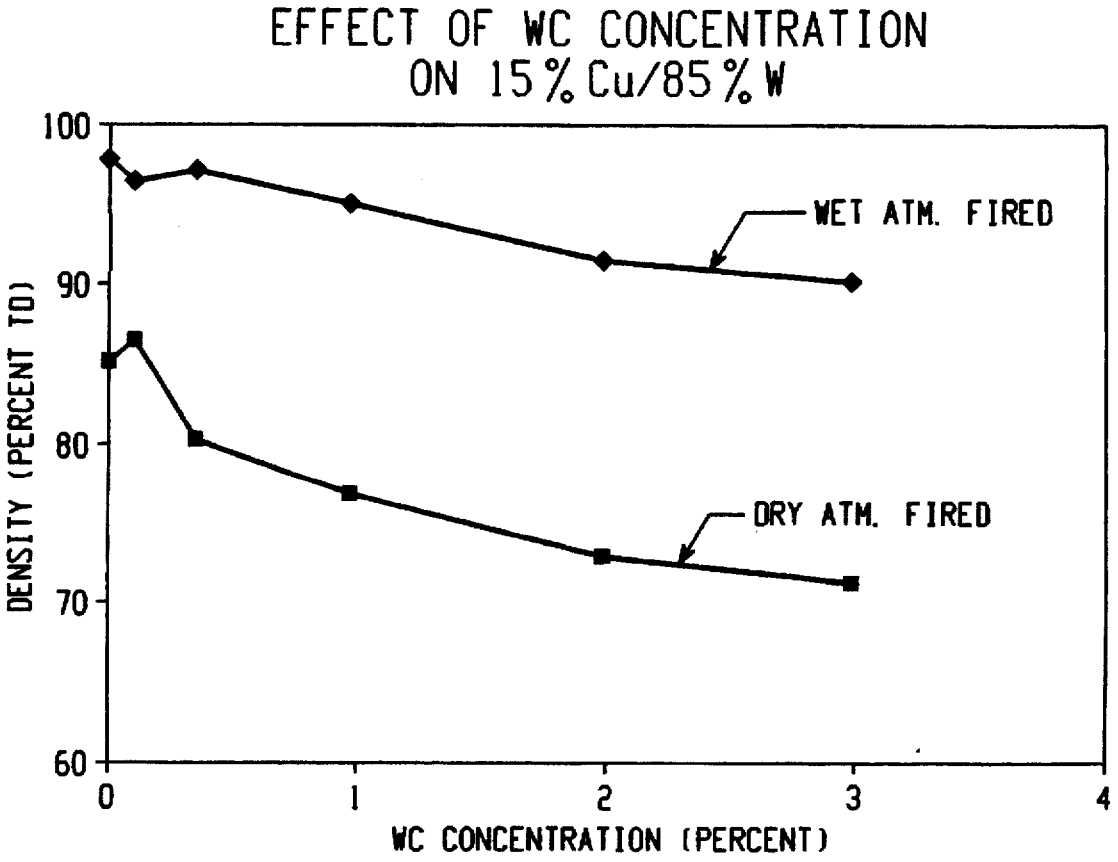
FIG. 2 is a graph illustrating the effect of tungsten carbide contamination as well as the effect of water in the sintering atmosphere in a copper/tungsten composite produced in accordance with the present invention.
Figure 3:
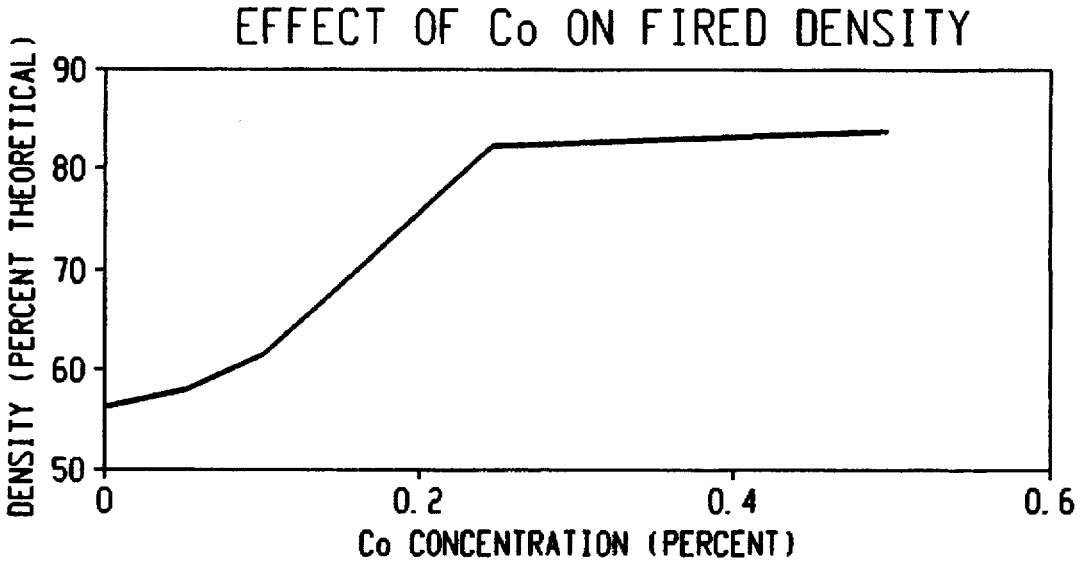
FIG. 3 is a graph illustrating the effect of cobalt as a sintering aid in another copper/tungsten composite formed in accordance with the present invention.

From FIG. 2, it can be seen that the concentration of cobalt in the particulate mixture to be fired has a significant effect on the density of the composite product obtained, at least until the cobalt concentrations reaches a certain value, about 0.3 wt. % in the particular embodiment shown.

Although only a few embodiments of the present invention have been described above, it should be appreciated that many modifications can be made without departing from the spirit and scope of the invention. For example, although the foregoing discussion relating to reducing spontaneous combustion of powdery sintering mixtures has been made in connection with forming copper/tungsten composites, it should be appreciated that this technique is applicable to any metal, metal oxide or other powdery material which exhibits spontaneous combustion. In particular, it is within the scope of the present invention to retard or eliminate spontaneous combustion of any fine particulate mass exhibiting the spontaneous combustion phenomenon by including in the mass sufficient corrosion inhibitor of the type described above to prevent spontaneous combustion from occurring. The amount of corrosion inhibitor needed for a particular application depends on the nature of the powdery mass being treated, both in terms of chemical composition and particle size, and can easily be determined by routine experimentation. Also, the corrosion inhibitor can be applied in any manner which will intimately admix the corrosion inhibitor with the other ingredients of the system. Preferably, as described above, the corrosion inhibitor is applied by mixing some or all of the particles in the mass subject to spontaneous combustion with a liquid containing the corrosion inhibitor preferably in solution.

All such modifications are intended to be included within the scope of the present invention, which is to be limited only by the following claims:

We claim:

1. A process for producing a composite containing copper and a transition metal, said process comprising sintering a compact of copper-containing particles and transition metal-containing particles in a reducing atmosphere, said compact containing at least 50 mole % chemically-bound oxygen based on the amount of copper in said compact.

2. The process of claim 1, wherein said transition metal is selected from the group consisting of tungsten and molybdenum.

3. The process of claim 2, wherein said reducing atmosphere contains water in an amount sufficient to improve sintering of said compacted mass.

4. The process of claim 3, wherein said compact is composed of a compacted mass of flowable agglomerates, said agglomerates containing said transition metal-containing particles and said copper-containing particles.

5. The process of claim 4, wherein said flowable mass has an angle of repose of 35 degrees or less and a Hall flow rate of about 40 seconds or less per 50 grams.

6. The process of claim 5, wherein said agglomerates contain an organic binder.

7. The process of claim 6, wherein said reducing atmosphere is hydrogen.

8. The process of claim 4, wherein at least one of said copper-containing particles and said transition metal-containing particles contains chemically combined oxygen.

9. The process of claim 4, wherein a mixture of copper oxide particles and tungsten metal particles having a mean particle size of 0.3 to 10 microns is spray dried to form a flowable mass of agglomerates having an angle of repose of about 35 degrees or less and a flowability of 40 seconds or less per 50 grams, wherein said flowable mass of agglomerates is compacted to form a self-supporting shaped article, and wherein said shaped article is sintered in a reducing atmosphere of hydrogen containing water in an amount such that said atmosphere at 20° C. is saturated in water.

10. The process of claim 4, wherein said mass further contains a sintering aid in an amount sufficient to improve sintering of said compacted mass.

11. A process for producing a composite containing copper and a transition metal, said process comprising sintering a compact of copper-containing particles and transition metal-containing particles in a reducing atmosphere, said compact containing chemically bound oxygen, the amount of chemically-combined oxygen in said mass being sufficient so that a copper metal/copper oxide eutectic forms in said mass during sintering.

12. A process for producing a composite containing copper and a transition metal, said process comprising sintering a compact of copper-containing particles and transition metal-containing particles in a reducing atmosphere containing water in an amount sufficient to improve sintering of said compacted mass, said compact also containing chemically-bound oxygen.

13. The process of claim 12, wherein said reducing atmosphere contains sufficient water so that at 20° C. said reducing atmosphere is saturated with water.

14. A process for producing a composite containing copper and a transition metal, said process comprising sintering in a reducing atmosphere a compacted mass of flowable agglomerates, said agglomerates containing transition metal-containing particles and copper-containing particles, said compacted mass containing chemically-bound oxygen in an amount sufficient to improve sintering of said compact.

15. The process of claim 14, wherein said flowable mass has an angle of repose of 35 degrees or less and a Hall flow rate of about 40 seconds or less per 50 grams.

16. A sintered composite comprising copper and at least one transition metal selected from the group consisting of tungsten and molybdenum, said composite having a density of at least 95% of theoretical, said composite being produced by sintering a compacted mass of copper-containing particles and particles of said transition metal, said compacted mass further containing at least 50 mole % chemically-bound oxygen based on the amount of copper in said compacted mass.

17. The sintered composite of claim 16, wherein said oxygen is chemically bound to at least one of said copper-containing particles and said transition metal-containing particles.

18. A process for improving sintering of a compacted mass of copper-containing particles and particles of a transition metal, said process comprising sintering said compacted mass in a reducing atmosphere containing sufficient steam to improve sintering of said compacted mass.

19. The process of claim 18, wherein said transition metal is selected from the group consisting of tungsten and molybdenum.

20. The process of claim 19, wherein said reducing atmosphere contains sufficient steam so that said reducing atmosphere is saturated with water at 20° C.

21. The process of claim 20 wherein said reducing atmosphere is hydrogen.

22. A process for producing a composite containing copper and a transition metal, said process comprising sintering a compact of copper-containing particles and transition metal-containing particles in a reducing atmosphere, said compact being composed of a compacted mass of flowable agglomerates, said agglomerates containing said transition metal-containing particles and said copper-containing particles, said agglomerates further containing chemically-bound oxygen.

23. The process of claim 22, wherein said agglomerates are formed into said compact without reducing the copper oxide, tungsten oxide or molybdenum oxide in said agglomerates, if any, to a metallic state.

24. The process of claim 23, wherein said flowable agglomerates have an angle of repose of 35 degrees or less and a Hall flow rate of about 40 seconds or less per 50 grams.

25. The process of claim 24, wherein said agglomerates contain an organic binder.

26. The process of claim 23, wherein said transition metal is tungsten or molybdenum and further wherein said reducing atmosphere is hydrogen.

* * * * *